United States Patent [19]

Uzaki et al.

[11] 4,289,194

[45] Sep. 15, 1981

[54] MOLDING MACHINE

[75] Inventors: Nagato Uzaki, Toyokawa; Yasutaro Kawamura, Okazaki; Kimikazu Kaneto, Toyokawa; Masaharu Hasizume, Chiryu; all of Japan

[73] Assignee: Sintokogio Ltd., Nagoya, Japan

[21] Appl. No.: 77,124

[22] Filed: Sep. 19, 1979

[30] Foreign Application Priority Data

Apr. 11, 1979 [JP] Japan ..... 54/44609

[51] Int. Cl.[3] ..... B22C 15/06; B22C 15/08

[52] U.S. Cl. ..... 164/170; 164/173; 164/207

[58] Field of Search ..... 164/37, 38, 40, 187, 164/195, 207, 210, 172, 170, 173

[56] References Cited

U.S. PATENT DOCUMENTS

| | | | |
|---|---|---|---|
| 1,086,824 | 2/1914 | Hewlett et al. | 164/195 X |
| 3,212,141 | 10/1965 | Hansberg | 164/195 |
| 3,516,475 | 6/1970 | Dougherty | 164/40 X |
| 3,807,483 | 4/1974 | Buhler | 164/195 X |

FOREIGN PATENT DOCUMENTS

| | | | |
|---|---|---|---|
| 2036232 | 1/1972 | Fed. Rep. of Germany | 164/207 |
| 44-17125 | 7/1969 | Japan | 164/207 |
| 54-35123 | 3/1979 | Japan . | |
| 54-38220 | 3/1979 | Japan . | |
| 282610 | 12/1970 | U.S.S.R. | 164/38 |

*Primary Examiner*—Robert D. Baldwin
*Assistant Examiner*—Gus T. Hampilos
*Attorney, Agent, or Firm*—Armstrong, Nikaido, Marmelstein & Kubovcik

[57] ABSTRACT

A molding machine has a base, a pattern provided with a plurality of vent bores formed therethrough and mounted on the base, a molding flask arranged to be combined with the pattern, an upset frame superposed to the molding flask, cover means for making an airtight contact at its lower end with the upper surface of the base, molding flask or of the upset frame. Further, compressed air supplying means are provided for supplying compressed air into the closed space defined by the pattern, the molding flask and the upset frame, the space being filled with molding sand. The cover means include a cylindrical member and cover member. The cylindrical member slidably fits to the outside of the cover member in a telescopic manner, and is provided at its lower end with an inwardly projected flange. In operation, the compressed air for compacting the molding sand acts also on the upper surface of the flange of the cylindrical member so as to depress the latter downward into airtight contact with the upset frame or the like. Consequently, the clamping cylinders, which have been essential in the conventional machine for preventing the floating of the cover means, are completely eliminated to simplify the construction of the molding machine.

16 Claims, 4 Drawing Figures

MOLDING MACHINE

BACKGROUND OF THE INVENTION

The present invention relates to a molding machine and, more particularly, to a molding machine in which compressed air is passed through molding sand filled in a molding flask to consolidate the thin layer of the molding sand covering over the surface of a pattern and then a squeeze operation is applied to the whole part of the molding sand in the mold flask.

Such molding machines have been known, which comprise a vertically movable table carrying a pattern having a large number of bores communicating with the ambient air, a molding flask with an upset frame, if necessary mounted on the table, a cover means closing the upper opening of the molding flask or the upset frame and provided with an air supply port, and means for supplying compressed air through the air supply port so that the compressed air then flows through the molding sand and is discharged through the bores of the pattern, whereby the molding sand in the molding flask and the upset frame is consolidated and compacted by the air so as to form a mold.

In this type of molding machine, a closed space is defined by the cooperation of the pattern, the molding flask, the upset frame and the cover means closing the upper opening of the upset frame. As the compressed air is introduced into this closed space, the cover means are inconveniently floated and lifted by the force exerted by the compressed air. In such a case, a clearance is formed between the cover means and the molding flask or the upset frame to allow the compressed air to escape therethrough to the outside.

Therefore, the clamp cylinder which is arranged to push the cover means against the upper surface of the molding flask or the upset frame, is required to have a large enough capacity to withstand this floating or lifting force. Therefore such a molding machine has various inconveniences such as enlargement of the size of the machine, complication of the mechanism and so forth.

SUMMARY OF THE INVENTION

It is, therefore, a major object of the invention to eliminate above described inconveniences of the prior art by providing a novel molding machine.

To this end, according to the invention, there is provided a molding machine comprising: a pattern provided at its desired portions with a plurality of vent bores; cover means for covering a molding flask or an upset frame so as to be arranged to make an airtight contact at the lower end of the peripheral wall thereof with the molding flask combined with the pattern, or the upset frame which is superposed to the molding flask combined with the pattern or with a base plate carrying the pattern thereby to form a closed space on the pattern; and means for supplying compressed air associated with the covering means and arranged to supply compressed air to the closed space, which compressed air releases to the outside through the bores formed in the pattern; wherein the covering means includes a cylindrical member and cover member slidably fitting in the cylindrical member in an airtight manner, and the area of the lower opening end of the cylindrical member is smaller than that of the upper end opening of the same.

The above and other objects, as well as advantageous features of the invention will become more clear from the following description of the preferred embodiments taken in conjunction with the accompanying drawings.

DESCRIPTION OF THE PREFERRED EMBODIMENTS

Figure 1:
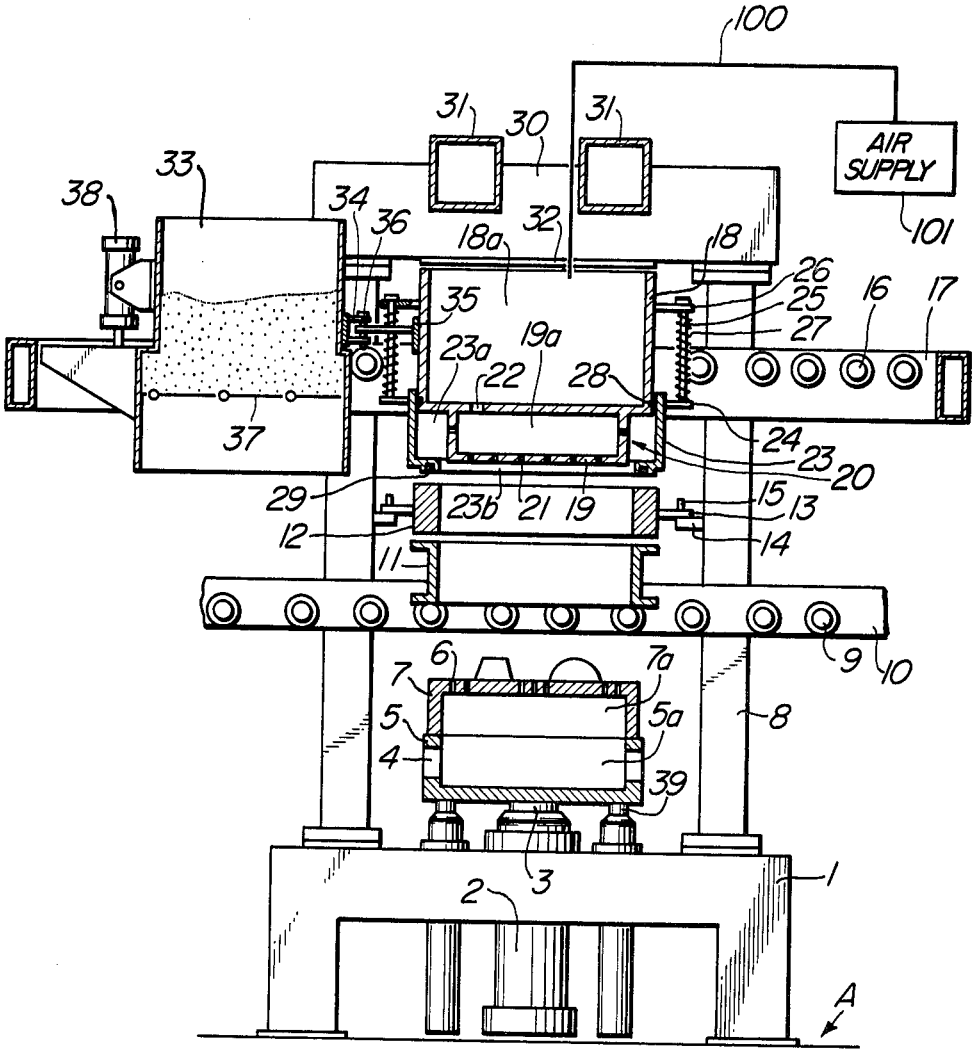
FIG. 1 is a sectional front elevational view of a molding machine which is an embodiment of the invention.

Referring to the drawings, a base 1 is situated on a foundation A. A cylinder 2 having an upwardly directed piston rod 3 is mounted in the central portion of the base 1. A table 5 connected to the upper end of the piston rod 3 has a recess or a cavity 5*a* and is provided at its both sides with air discharge ports 4. A pattern 7 is provided at its lower surface with a recess or cavity 7*a* and a number of vent bores 6 extending through the thickness of top wall thereof. This pattern 7 is attached to the upper surface of the table 5. More specifically, these vent bores 6 are formed in portions of the pattern 7 where the squeezing pressure during a squeeze operation is less likely to be exerted, that is, where the desired hardness of a mold to be formed is difficult to obtain. Each vent bore is associated with a vent plug (not shown) embedded in the pattern. These vent bores 6 are in communication with the air discharge ports 4 through the cavities 5*a*, 7*a*.

A column 8 stands up from each corner of the base 1. Between each pair of columns 8, a pair of roller conveyors 10 having a substantially equi-spaced large number of flanged rollers 9 passes through. These roller conveyors 10, 10 are spaced from each other in the breadthwise direction by a distance which is large enough to permit the table 5 to pass through therebetween.

On the roller conveyors 10, a rectangular molding flask 11 is mounted. The molding flask 11 is carried at its side edges by the peripheral edges of the flanged rollers 9 of the roller conveyors so as to be freely moved along the latter.

A reference numeral 12 denotes an upset frame which has inside and outside widths which are substantially equal to those of the molding flask 11. The upset frame 12 is carried by the columns 8 free for up and downward movement through its laterally and outwardly extending legs 13 engaged and guided by guide pins 15 which are planted in the upper surface of brackets 14 projected inwardly from the columns 8.

In the illustrated state in which the legs 13 of the upset frame 12 are received on the bracket 14 with forming a predetermined clearance between the lower end of the upset mold 12 and the upper end of the molding flask 11 which is carried by the roller conveyors.

Another pair of roller conveyors 17, each having a large number of substantially equi-spaced flanged rollers 16, are disposed above the upset frame 12 carried by the bracket 14. These roller conveyors 17 extend in the same direction as the first-mentioned pair of roller conveyors 10.

A cover member 18 is movably carried by the roller conveyors 17 through its support brackets (not shown) projected from the side ends thereof.

The cover member 18 defined therein an internal cavity 18*a* opening at the upper end thereof. The cover member 18 is integrally formed with a squeeze head 20 including a hollow squeeze board 19 having an outside measurement slightly smaller than the inside measurement of the upset frame 12 and an internal cavity 19*a* defined therein.

The internal cavity 19*a* of the squeeze board 19 is communicated with the outside through a multiplicity of small bores 21, and is arranged to be supplied with compressed air through an air supply port 22 formed in the top panel of the squeeze board 19 which top panel divides the internal cavity 19*a* from the cavity 18*a*. The compressed air is fed through a pipeline 100 from air supply 101.

A cylindrical member 23 has an upper end opening 23*a* which is slidably fitted onto the outside of the lower portion of the cover member 18. The lower end opening 23*b* of the cylindrical member 23 is provided with an inwardly projected flange. The lower end opening 23*b* has a size which corresponds to the size of the opening of the upset frame 12 and which is smaller than the size of the upper end opening 23*a*. The cylindrical member 23 is provided with arms 24 projected outwardly from both sides thereof, and is suspended through these arms 24 from brackets 26 formed in the both sides of the cover member 18, through the medium of the suspension rods 25. A compression spring 27 wound around each suspension rod 25 acts between the arm 24 and the bracket 26 so as to depress the cylindrical member 23. A sealing member 28 is received by a groove formed in the peripheral surface of the cover member 18 through which the cylindrical member 23 makes a sliding and airtight contact with the cover member 18. At the lower end of the cylindrical member 23, embedded over the entire circumference of the latter is a sealing member 29 which is arranged to provide an airtight contact between the upper end of the upset frame 12 and the downwardly projected lower end of the cylindrical member 23 when the latter is moved downwardly.

In the state shown in FIG. 1 in which the cylindrical member 23 is suspended by the suspension rods 25, the sealing member 29 is spaced by a predetermined distance from the upper end of the upset frame 12 which is carried by the brackets 14 through the legs 13. A reference numeral 30 denotes ceiling frames which are mounted on the tops of the columns 8. Reinforcement girders 31 are extended between these ceiling frames 30 at the middle of the latter. A reference numeral 32 denotes a stopper member which is fixed to the lower surfaces of the ceiling frames 30. A molding sand hopper 33 is arranged to hold a batch of molding sand and is movably carried by the flanged rollers 16 of the roller conveyors 17. The molding sand hopper 33 has a connecting tab 34 projected from the right side wall thereof. The connecting tab 34 is jointed through a joint pin 36 to a connecting tab 35 which is projected from the left-side end wall of the cover member 18, so that the hopper 30 is movable to the left and right along the roller conveyor 17 together with the cover member 18.

A reference numeral 37 denotes a plurality of dampers which constitute the bottom of the hopper 33. These dampers are rotatable between an opening position and a closing position by means of a cylinder 38 which is fixed to the hopper 33. The cover member 18 and the hopper 33 are movable along the roller conveyor 17 by suitable driving means which are neglected from the drawings. A reference numeral 39 denotes a guide pin adapted for preventing the table 5 from rotating in a horizontal plane. Although not shown, sealing members are embedded in the lower surface of the upset frame 12 and in the upper surface of the pattern 7 for achieving airtight seal between the upset frame 12 and the molding flask 11 and between the molding flask 11 and the pattern 7, when these members are brought into contact together.

The molding machine of this embodiment having the described construction operates in the manner which will be described hereinunder.

The cover member 18 together with the hopper 33 is moved to the right from the position shown in FIG. 1 by means of the driving means not shown thereby to place the hopper 33, which holds a batch of molding sand, at a position just above the upset frame 12. Subsequently, as the cylinder 2 is actuated, the pattern 7 is moved upward together with the table 5 into engagement with the molding flask 11 located just above the pattern 7. Subsequently, the molding flask 11 is moved upward into engagement with the upset frame 12. The operation of the cylinder 2 is stopped just before the upper surface of the upset frame 12 is brought into contact with the lower surface of the hopper 33. Subsequently, as the cylinder 38 is actuated, the dampers 37 are rotated to the opening position to release the molding sand in the hopper 33 into the space defined by the molding flask 11 and the upset frame 12.

Thereafter, the aforementioned driving means (not shown) is actuated again to place the cylindrical member 23 and the cover member 18 to the position just above the upset frame 20. Then, the cylinder 2 is actuated again to lift the table 5 mounting the pattern 7, the molding flask 11 and the upset frame 12 until the upper end of the latter is brought into a airtight contact with the cylindrical member 23 through the sealing member 29.

Then, compressed air is supplied through the air supplying port 22 and is introduced into the space defined by the upset frame 12 and the molding flask 11, through the internal cavity 19*a*, the small bores 21 and the space defined between the lower surface of the squeeze head 20 and the inner surface of the cylindrical member 23. This air then flows across the layer of the molding sand filling the space defined by the upset frame 12 and the molding flask 11 so as to consolidate and compact the sand on the surface of the pattern 7. As a result, a layer of consolidated sand is formed covering over the surface of the pattern 7, and only the air is discharged to the outside through the vent plugs (not shown), the vent bores 6, the cavities 5*a*, 7*a* and then through the discharge port 4.

Meanwhile, the compressed air exerts a force on the inwardly projecting flange of the cylindrical member 23 so as to press the latter downward against the upper surface of the upset frame 12 through the sealing member 29. As a result, an airtight contact is achieved between the cylindrical member 23 and the upset frame 12.

On the other hand, the squeeze head 20 is pressed upwardly, i.e. in the reverse direction as the direction in which the cylindrical member 23 is pressed, but is prevented from excessively moving upward by the stopper member 32. The airtight contact between the squeeze head 20 and the cylindrical member 23 is preserved by means of the sealing member 28.

After a while, the supply of the compressed air is stopped and the cylinder 2 is actuated to move the table 5, the molding flask 11 and the upset frame 12 upward as a unit, so that the molding sand filling the space in the molding flask 11 as well as the upset frame 12 is squeezed to form the mold of a predetermined compactness and shape.

Subsequently, the cylinder 2 is reversed to lower the cylindrical member 23, the upset frame 12, the molding flask 11 and the pattern 7 to the illustrated position, thereby to allow the parting of the mold from the pattern.

On the other hand, the hopper 33 is moved back to the illustrated position by the driving means not shown, and is supplied by suitable means (not shown) with the next batch of the molding sand before the parting is completed.

After the parting, the formed mold remains in the molding flask 11. This molding flask 11 holding the mold is then moved along the roller conveyor 10 by suitable driving means not shown in one direction, while a new empty molding flask 11 is brought to the position just above the pattern 7. Thereafter, the above described process is repeated to form the next mold.

Figure 2:
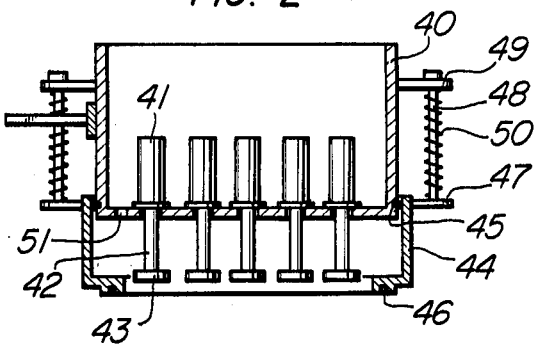
FIG. 2 is a sectional view of another form of a squeezing device incorporated in the molding machine shown in FIG. 1.

FIG. 2 shows a modification of the embodiment shown in FIG. 1. This modification has a different form of the squeeze device. Referring to FIG. 2, a reference numeral 40 denotes a cover member having an internal cavity which is opened at its upper end. A plurality of squeeze cylinders 41 is mounted in the internal cavity of the cover member each having of a piston rod 42. The piston rods 42 are extended downward through the bottom wall of the cover member 40. A squeeze foot 43 is fixed to the lower end of each piston rod 42.

A cylindrical member 44 has an upper end opening which fits slidably and in an airtight manner to the outside of the lower end of the cover member 40, through a medium of a sealing member 45. The cylindrical member 44 is provided in its lower end portion with an inwardly projecting flange, so that the size of the lower end opening of the cylindrical member is smaller than that of the upper end opening of the same. A sealing member 46 is embedded in the lower face of the flange of the cylindrical member 44 over the entire circumference of the latter. This sealing member 46 is projected slightly downwardly to provide an airtight seal between the cylindrical member 44 and the upper surface of the upset frame 12 when the cylindrical member 44 is superposed to the latter.

The cylindrical member 44 is suspended from the side brackets 49 of the cover member 40 through suspension rods 48 connected to the arms 47 projected laterally therefrom. A compression spring 50 fitted around each suspension rod 48 acts between the arm 47 and the bracket 49 to depress the cylindrical member 44 downward. A reference numeral 51 denotes a port through which the compressed air is introduced.

In operation, compressed air is made to flow across the layer of the molding sand filling the space defined by the pattern 7, the molding flask 11 and the upset frame 12, so as to uniformly consolidate and compact the layer of the molding sand covering over the surface of the pattern 7. In this case, it is not necessary to lift the pattern 7, the molding flask 11 and the upset frame 12 as a unit upward as made in the previously described embodiment, but the squeeze feet 43 are merely moved downward. Needless to say, it is possible to use a single squeeze plate in place of the plurality of squeeze feet 43. It is also possible to depress the squeeze feet or the squeeze plate making use of the force of the compressed air supplied through the air supplying port 51, insteadly of making use of the squeeze cylinders. In the latter case, the squeeze cylinders can be dispensed with to remarkably simplify the construction of the mechanism.

In the described embodiment and its modification, the cylindrical members 23, 44 are suspended from the cover members 18, 40 through the suspension rods 25, 48. This arrangement, however, is not exclusive, and the suspension rods 25, 48 may be substituted by suitable cylinders.

Figure 3:
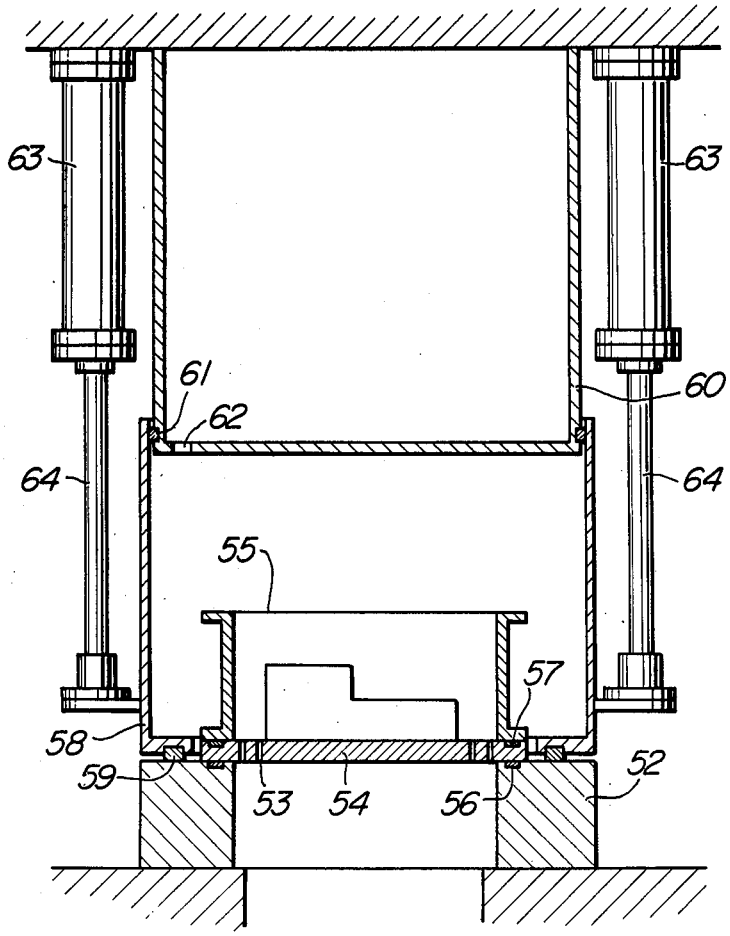
FIG. 3 is a sectional front elevational view of another embodiment of the invention.
Figure 4:
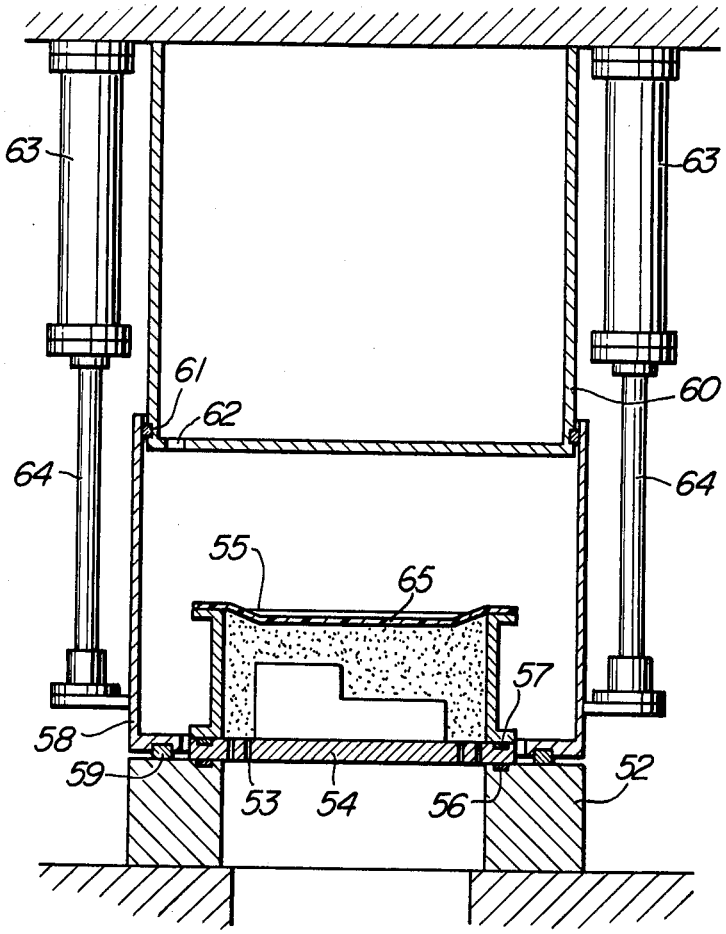
FIG. 4 is a sectional front elevational view of the embodiment of FIG. 3 using a flexible film member.

Referring now to FIG. 3 showing another embodiment different from that shown in FIG. 1, a base 52 carries a pattern 54 having a multiplicity of small bores 53 formed therethrough. A molding flask 55 is mounted on the pattern 54. A sealing member 56 embedded in the base 52 is adapted to provide an airtight seal between the base 52 and the pattern 54, while a sealing member 57 embedded in the pattern 54 preserves an airtight seal between the pattern 54 and the molding flask 55 carried by the latter.

A reference numeral 58 denotes a cylindrical member provided at its lower end with an inwardly projected flange. Thus, the cylindrical member 58 has a lower end opening of a size smaller than that of the upper end opening of the same. A sealing member 59 is embedded in the lower surface of the cylindrical member 58 over the entire circumference of the latter. This sealing member 59 is projected slightly downwardly so as to provide an airtight seal between the cylindrical member 58 and the base 52 when the latter is brought into contact with the cylindrical member 58.

A hollow cover member 60 is suspended from the ceiling. The cylindrical member 58 fits slidably and in an airtight manner to the outside of the lower part of the cover member 60 through a medium of the sealing member 61. A reference numeral 62 denotes a port through which the compressed air is supplied. A reference numeral 63 denotes a pair of cylinders which are secured at their base ends to the ceiling, such that their piston rods 64 are extended downwardly. These piston rods 64 are connected at their ends to the legs 65 projected laterally from both sides of the cylindrical member 58, so that the cylindrical member 58 is movable up and down along the outer surface of the cover member 60 as the piston rods 64 are retracted and extended.

This embodiment having the described construction operates in a manner described hereinunder. As the cylindrical member 58 is raised by the operation of the cylinders 63 away from the base 52, the molding flask 55 is placed on the pattern 54 by the operator and the space defined by the molding flask 55 and the pattern 54 is filled with the molding sand. Then, as the cylinders 63 are actuated again, the cylindrical member 58 is lowered so that the cylindrical member 58, the cover member 60 and the base 52 define a closed space in cooperation with the pattern 54. Subsequently, compressed air is introduced into this closed space through the air supplying port 62. As a result, the air flows through this closed space into the molding flask 55 and penetrates the molding sand contained by the latter thereby to compact and consolidate the molding sand on the surface of the pattern 54. As a result, a layer of compacted molding sand is formed over the surface of the pattern 54, while the air is released to the outside through the vent bores 53.

Meanwhile, the compressed air exerts a force on the inner peripheral flange of the cylindrical member 58 to press the latter against the upper surface of the base 52. Therefore, the undesirable leak of the air to the outside through the gap between the cylindrical member 58 and the base 52 is fairly avoided. This means that it is not necessary to clamp the cylindrical member 58 by means of the cylinders 63, so that the cylinders 63 are required to have only a small capacity which is sufficient to move the cylindrical member 58.

After a while, the supply of the compressed air through the air supplying port 62 is stopped and the cylinders 63 are actuated again to lift the cylindrical member 58 away from the base 52. Then, a flexible film member 65 is laid on the upper surface of the molding flask 55. Then, the cylinders 63 are energized again to lower the cylindrical member 58, so that the molding flask 55 holding the molding sand is covered and sealed by means of the cylindrical member 58.

Subsequently, compressed air is supplied through the air supplying port 62 so as to squeeze the molding sand, through a medium of the flexible film, thereby to form the mold of a predetermined compactness.

From the foregoing description, it will be apparent that, according to the invention, the clamp cylinders for clamping and pressing the cover means to the upset frame or the molding flask is completely eliminated to simplify the construction of the mechanism and the size of the molding machine as a whole is conveniently reduced. In addition, the installation cost is very much reduced since the construction of the molding machine of the invention permits the mechanical parts to have reduced mechanical strength. Further, various troubles derived from the clamp cylinders are fairly avoided to ensure the safe and efficient operation of the molding machine.

What is claimed is:

1. A molding machine comprising:

a pattern provided with a plurality of vent bores formed at desired portions thereof;

a molding flask arranged to be combined with said pattern;

means for sealingly covering said molding flask and said pattern combined with said molding flask so as to form a closed space above said pattern; and means, mounted in said covering means, for supplying compressed air into said closed space, said compressed air being discharged from said closed space to the outside through said vent bores, wherein said covering means comprises a cover member, and a hollow cylindrical member defining an upper end opening and a lower end opening, said cover member being air-tightly, slidably engaged in said cylinder member through said upper end opening, said lower end opening being defined by a flange extending radially inwardly of said cylindrical member such that said lower end opening has an opening area less than that of said upper end opening so as to form an effective pressure receiving chamber defined by said cylindrical member, flange, and cover member whereby said compressed air supplied to said chamber through openings in said cover means will forcedly push said cylindrical member in the direction towards said pattern.

2. A molding machine as set forth in claim 1, wherein an upset frame is arranged to be disposed on said molding flask.

3. A molding machine as set forth in claim 1, wherein said pattern combined with said molding flask is supported on a base, and said cylindrical member is sealingly pressed against said base.

4. A molding machine as set forth in claim 1, characterized by further comprising a sealing member attached to a lower surface of said flange, and another sealing member disposed between a sliding surface of said cover member and that of said cylindrical member.

5. A molding machine as set forth in claim 1, 2 or 3 wherein said cover member comprises a cylindrical body closed at a upper end thereof, and is telescopically received by said cylindrical member to define said effective pressure receiving chamber.

6. A molding machine as set forth in claim 1, 2 or 3 further comprising means disposed between said cylindrical member and said cover member for biasing said cylindrical member and said cover member away from each other.

7. A molding machine as set forth in claim 6, wherein said biasing means comprises first arms projected outwardly from both sides of said cover member, bores formed in respective first arms, suspension rods having upper end portions of an increased diameter and inserted into said bores, second arms projected outwardly from both sides of said cylindrical member so as to align with said first arms, said suspension rods being connected at their lower ends to said second arms, and a resilient member interposed between each pair of said first and second arms biasing said cylindrical member away from said cover member.

8. A molding machine as set forth in claim 1, 2 or 3 wherein said cylindrical member and said cover member are connected to each other by a piston and a cooperative cylinder.

9. A molding machine as set forth in claim 1 or 2 wherein said cover member is provided with a squeeze plate.

10. A molding machine as set forth in claim 9, wherein said squeeze plate is fixed to said cover member which is movable up and down, said molding machine further comprising a stopper adapted to contact said cover member to prevent the latter from excessively moving upward, and means for moving said pattern up and down, whereby said squeeze plate makes a squeezing action as said cylindrical member is slidingly moved upward along said cover member by said pattern moving means.

11. A molding machine as set forth in claim 9, wherein said squeeze plate includes moving means mounted on said cover member for driving said squeeze plate.

12. A molding machine as set forth in claim 11, wherein said compressed air acts on an upper surface of said squeeze plate to impart a squeezing power to the latter.

13. A molding machine as set forth in claim 11, wherein said squeeze plate is divided into a plurality of sections, while said squeeze plate moving means are arranged to move said sections of said squeeze plate up and down independently.

14. A molding machine as set forth in claim 3, wherein said cylindrical member is arranged to make an airtight contact at a lower peripheral edge with said base supporting said pattern, said molding machine further comprising a flexible film member which is adapted to close an upper end opening of said mold flask, whereby the compressed air acts on said film to squeeze the molding sand which has been supplied to fill the space in said molding flask.

15. A molding machine as set forth in claim 1, wherein said cover member is movable up and down, said molding machine further comprising a stopper disposed above said cover member so as to be contacted by the latter to prevent if from excessively moving upward, whereby said compressed air acts to press said cover member against said stopper and, simultaneously, to push said cylindrical member toward said pattern.

16. A molding machine as claimed in claim 1, 2 or 3 wherein said cover member is kept stationary.

* * * * *